United States Patent [19]

Stuck et al.

[11] Patent Number: 4,539,930

[45] **Date of Patent: * Sep. 10, 1985**

[54] CASTING AND COATING WITH METALLIC PARTICLES

[75] Inventors: Earl N. Stuck, Wareham, Mass.; Victor F. Zackay, New Canaan, Conn.

[73] Assignee: Teledyne Industries, Inc., New Bedford, Mass.

[ * ] Notice: The portion of the term of this patent subsequent to Sep. 20, 2000 has been disclaimed.

[21] Appl. No.: 604,972

[22] Filed: Apr. 27, 1984

Related U.S. Application Data

[60] Division of Ser. No. 532,537, Sep. 15, 1983, Pat. No. 4,486,470, which is a continuation-in-part of Ser. No. 427,900, Sep. 29, 1982, Pat. No. 4,405,296, which is a division of Ser. No. 300,224, Sep. 8, 1981, Pat. No. 4,374,789.

[51] Int. Cl.[3] ..... B05B 1/02

[52] U.S. Cl. ..... 118/300; 427/196; 427/421; 164/46; 264/12; 264/13; 264/14; 425/6; 425/7; 239/DIG. 7

[58] Field of Search ..... 427/196, 421, 426; 118/300; 164/46; 264/12, 13, 14; 425/6, 7, 10; 239/DIG. 7

[56] References Cited

U.S. PATENT DOCUMENTS

| | | | |
|---|---|---|---|
| 3,951,577 | 4/1976 | Okayama et al. | 425/7 |
| 3,972,150 | 8/1976 | Hart | 239/314 X |
| 4,004,733 | 1/1977 | Law | 239/DIG. 7 X |
| 4,060,355 | 11/1977 | Walz et al. | 239/DIG. 7 X |
| 4,377,985 | 3/1983 | Reba | 118/300 |
| 4,405,296 | 9/1983 | Stuck et al. | 425/7 X |

*Primary Examiner*—Shrive P. Beck

*Attorney, Agent, or Firm*—Shoemaker and Mattare, Ltd.

[57] ABSTRACT

A device for producing metallic particles utilizing the Coanda Effect to draw one stream of gas toward another stream of gas flowing over a foil. Molten metal is introduced between the two gas streams, and the resulting interaction breaks up the molten metal flow into particles of appropriate size, shape, composition and the like. Various embodiments can be used for the process of producing cast articles, while other versions can be used for the process of coating and deposition of the particles in liquid, solid or partially solidified form onto a substrate.

18 Claims, 7 Drawing Figures

CASTING AND COATING WITH METALLIC PARTICLES

This is a division of application Ser. No. 532,537 now U.S. Pat. No. 4,486,470, filed Sept. 15, 1983; which is a continuation-in-part of Ser. No. 427,900, now U.S. Pat. No. 4,405,296 filed 9-29-82; which is a division of Ser. No. 300,224 now U.S. Pat. No. 4,374,789 filed 9-8-81.

BACKGROUND OF THE INVENTION

1. Field of the Invention

The present invention relates to processes of coating, consolidating and casting metal particles produced by the Coanda Effect onto a substrate or collector/holder. The apparatus used for effecting the processes is also described.

2. Description of the Prior Art

Composite structures are often prepared in which a coating of special-purpose metallic material is applied to a substrate of a base metal to become an integral structure which possesses desirable surface characteristics. Hard coating for severe wear applications is a typical use which requires application of special surfaces by means other than plating. Techniques presently available are very slow and expensive.

Metallic coating processes other than plating include thermal spray coating, chemical vapor deposition, vacuum coating, sputtering, ion plating, ion implantation, etc. These are described in Volume 5 of the 9th Edition of the *Metals Handbook* published by the American Society for Metals.

Production of super alloys with superior properties and fineness of micro-structure are produced by a variety of melting, powder metallurgy and consolidation techniques. These include: vacuum induction melting, vacuum arc remelting, powder metallurgy, hot isostatic pressing, extrusion, forging, and the VADER process.

These are typically expensive and complex operations since the severe requirements imposed upon these super alloys require extreme purity and the virtual elimination of inclusions. Many of the most extreme applications are considered to be unachievable by existing powder metallurgy techniques. Recent developments, such as the VADER process, eliminate the powder manufacturing step by the consolidation of semi-liquid droplets (above the solidus temperature, but below the liquidus temperature), which are generated from two consumable electrodes. This is considered to be a likely improvement in production of super alloys required for severe applications. This process is inherently more conserving of energy and capable of producing fine-grained super alloy material which is virtually free of inclusions. The process is, however, a slow one and its cost may preclude its use in all but the most special applications.

There is, therefore, a need for a coating process and apparatus which will produce coatings having special characteristics which are faster and cheaper than those known today. Further, there is a need for a process of producing these special super alloys free of impurities and weaknesses resulting from the prior art processes. There is also a need for a process that will be less expensive and faster than the prior art processes, and also a need for apparatus to effect this process.

SUMMARY OF THE INVENTION

It is, accordingly, one object of the present invention to provide a new process and apparatus for coating substrates.

A further object of the present invention is to provide a process for coating substrates to produce composite structures which are fully integrated with the base metal.

A still further object of the present invention is to provide a new coating process and apparatus for coating substrates with particles produced by the Coanda Effect.

Yet another object of the present invention is to provide a process and apparatus for coating a substrate with metal particles in a single phase (solid or liquid) or partially solidified.

Another, further object of the present invention is to provide a process of casting metals from metal particles produced by the Coanda Effect, and to provide the apparatus needed for effecting this process.

It is a further object of the present invention to provide a device and method of coordinating the production of metal droplets in either single phase (molten or solid) or in a two-phase (partially solidified) form produced by a Coanda type device with a collecting device to produce a metallic object.

A still further object of the present invention is to produce metal particles at a high rate of production in any phase and consolidate the same in a variety of forms so as to achieve a solid mass of extreme fineness of microstructure.

Another object of the present invention is to set forth both a coating and a casting process which is fast and far less expensive than prior art processes.

Yet another object of the present invention is to create a wide variety of metallic compositions having structures and associated properties not achievable by other processes.

A still further object of the present invention is to provide a process and apparatus which will produce metal particles, inexpensively, at extremely high production rates for consolidation by casting with or without compaction.

An additional object of the present invention is to provide a process and apparatus for producing castings having the fineness of grain structure and purity at higher production rates, thereby making the technology available for a much wider range of applications.

These and other advantages of the present invention will become apparent from the following detailed description and drawings.

In accordance with the above objects, it has been found that metal coatings can be generated, applied and integrated with metallic substrates to form composite structures, using the Coanda Effect to produce said coatings.

The coating is developed by deposition of a high-velocity spray of molten metal, or mixtures of metals upon a substrate, causing a build-up of coated material which is, in itself, homogenous and becomes integrally bonded to the substrate. Very high speeds of coating are possible because of the application of a Coanda Effect generator as a spray deposition device. The process/device will interact with a suitable melt process for generation of metal particles to be consolidated upon a substrate and become an integral structure which possesses desirable qualities of surface. The process utilizes a device capable of generation of molten metal droplets of various size and will permit introduction of various gaseous atmospheres to impart specific properties to the droplets generated. This atmosphere may also be used as a carrier for other modifying elements in particle or liquid form.

Also, in accordance with the above objects, a new process and apparatus has been found which can produce metal castings having fineness of grain structure. Further, this process and apparatus produces these castings at a much faster rate than previously known in the art. In addition, the apparatus for use in this process is simple and easy to maintain. The present invention combines the use of the Coanda Effect to produce metal particles which can be cast into solid forms. The use of the Coanda Effect for producing metal particles is set forth in U.S. Pat. No. 4,374,789 and in co-pending application Ser. No. 427,900, filed Sept. 29, 1982, incorporated herein by reference.

The Coanda Effect can be described as the tendency of a gas or liquid coming out of a jet to travel close to a wall contour, even if the wall curves away from the axis of that jet. In so doing, a negative pressure is created (in a manner similar to an airplane wing) which causes adjacent environmental fluid to be entrained. This entrainment phenomenon results in severe turbulence at the boundary layer. If a third fluid is introduced into the entrainment zone, it becomes a part of the system and is violently involved by the force of the entrainment. If this introduced fluid is a molten metal stream, said stream is disintegrated into a spray which is discharged from the foil surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
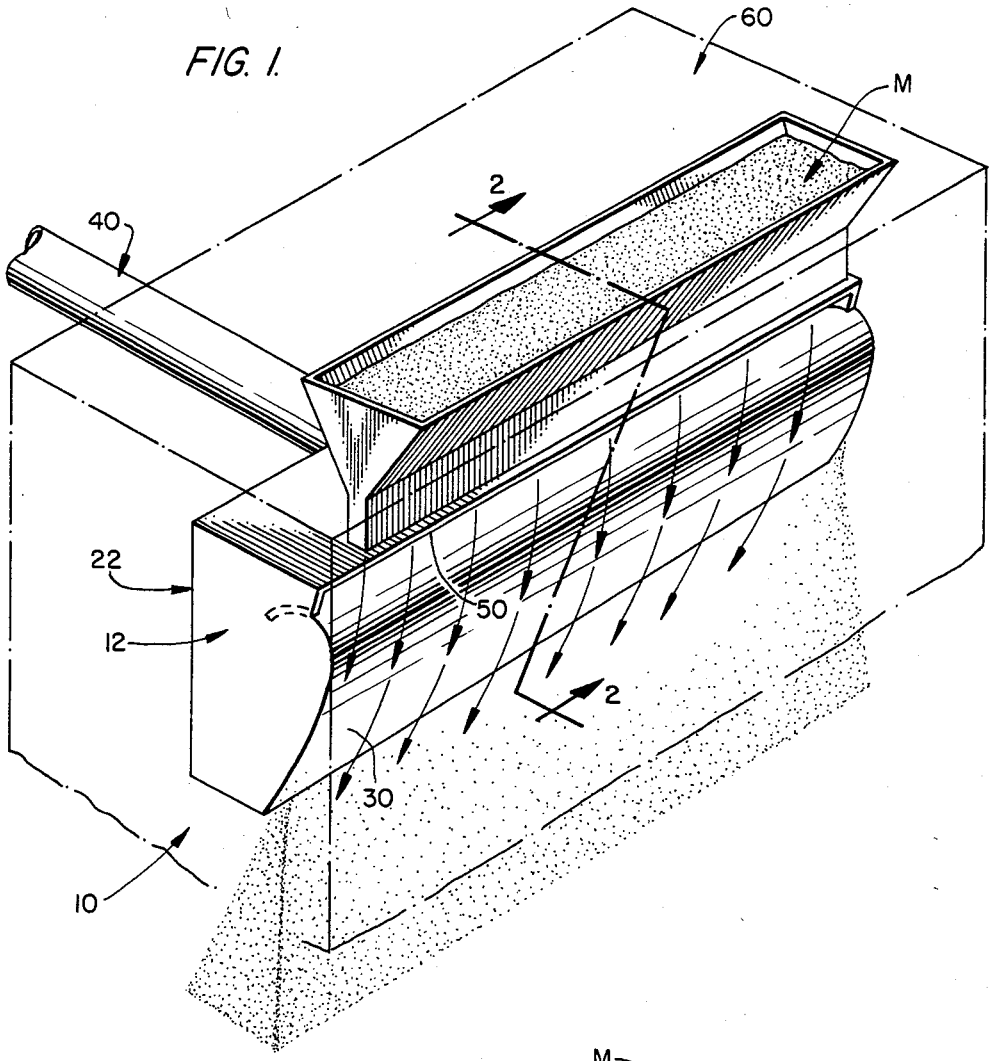
FIG. 1 is a perspective view of a device embodying the teachings of the present invention.

The main elements of the device are: a chamber into which fluid (gas) may be forced under pressure; a slit of appropriate size to permit escape of the fluid at the desired velocity; a foil surface adjacent to the slit to which the primary fluid may attach and induce the entrainment phenomenon.

A wide range of process output can be achieved by exercise of the many variables available in the device and process.

The particles produced by this device can have a single-phase, either molten or solid, or they can have two-phases resulting in a mushy, partially solidified, particle. These particles are deposited on substrates or in molds to produce cast products. When desired, as when solid particles are produced, they can be further formed by compaction.

A major advantage of the Coanda device is its inherent speed and the ease in which the device can be scaled up or extended dimensionally. The production rate of these particles is very high, thus out-performing the prior art methods of vacuum arc re-melting, powder metallurgy and VADER process in both speed and economy of production. This further eliminates many of the subsequent treatments of the cast product, except where solid particles are produced. The particles produced for casting can be made with various apparatus, depending on the configuration of the cast product.

Further, the particles produced can have various qualities and characteristics imparted to them during production due to the uniqueness of the apparatus and which will result in innumerable products.

Furthermore, this invention includes apparatus to generate a high rate of molten metal droplets, either single-phase (molten), or, preferably, two-phase (mushy) from a liquid stream of appropriate geometry; and, subsequently, consolidate in a variety of forms so as to achieve a solid mass of extreme fineness of microstructure with minimum contamination of the solid by non-metallic particles. This method embodies the application of the Coanda Effect to generate the molten-metal droplets. Of course, the shape of the cast metallic object can be altered by use of appropriate placement, geometrics, and configuration of the generation device and associated collection surfaces. Billets or ingots can also be produced from a device which includes a collector which moves away from the Coanda generating device.

Another feature is the producing of a plate or strip of cast material from a linear Coanda generator associated with a surface moving traversely thereto. This arrangement can be used in material coating processes which would include hard faced alloys.

Other apparatus can be used to coat elongated pipe by spraying such pipe which is advanced as well as rotated during the coating process. Again, a linear Coanda generator can be used, or circular types, or other various configurations. In some applications, the pipe can be preheated so that the deposited metal particles will bond therewith. Such applications can be used for hard facing rolls. Corrosion resisting coatings for pipe and other components can also be applied by this process and apparatus for use in the chemical processing industry, etc.

A further important feature of this invention is to generate, apply and integrate a coating of desired metallic particles with a metallic substrate to form a composite at the junction thereof. With such structures, the coating is developed by deposition of a molten metallic spray upon a substrate causing a buildup of coated material which is, in itself, homogeneous and integrally bonded to the substrate. With such apparatus and processes, very high speeds of coating are possible.

Another feature is to provide an array of Coanda generator devices in combination for the desired coating and/or depositing on the collector surface. Devices in various forms can buildup an ingot by spraying in various directions.

Shown in FIG. 1 is a Coanda device 10 comprised of a chamber 12 enclosed by a housing 22 in which one side thereof is a curved surface 30 forming a Coanda surface. The curvature may be designed to meet the requirements of any individual application. The housing contains an opening 40 through which the primary fluid is introduced under the required pressure to achieve the appropriate flow velocity through slit 50 in order to effect attachment of the primary fluid to the curved surface.

An environmental or second fluid, which may be enclosed by an outer chamber 60, will be entrained by the primary fluid which results in severe turbulence at the boundary layer.

Figure 2:
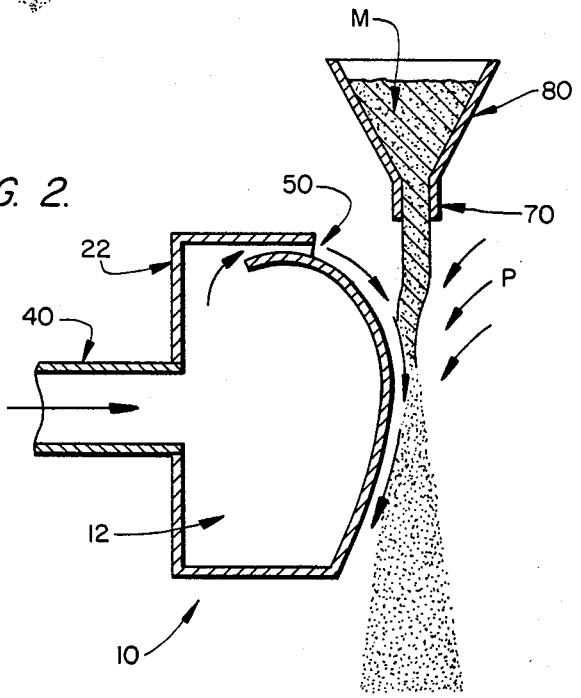
FIG. 2 is a view taken along line 2—2 of FIG. 1.

A third fluid M introduced into the entrainment zone P shown in FIG. 2 becomes a part of the system and is violently involved by the forces of entrainment. If this introduced third fluid is a molten metal stream, said stream is disintegrated into a spray which is discharged from the foil surface. Such metallic stream may be introduced into the entrainment zone P through holes, slits or other orifice configurations 70 which permit this flow from a tundish 80 which holds the metal supply.

The tundish 80 may be configurated to fit the application (deposition configuration) and may be designed to dispense molten material in a straight line, a circle or any other configuration which the application requires. The finer the stream of metal flow, the finer and more consistent the resulting droplet spray. Therefore, the molten metal may be dispensed through holes of various diameters, slots, etc.

As with the tundish, the Coanda device 10 might be designed in a wide variety of configurations. It may be straight line, circular, square, irregular, helical, or any other configuration which satisfies the application.

The curved surface of the device may be a part of the device chamber or may be separated from the chamber if required to permit added flexibility in altering spray direction. By adjustment of the foil attitude, the direction of the spray may be altered to achieve deposition and directions other than straight down.

Size of the slit 50 may be adjusted for desired effect upon entrainment or velocity and volume of escaping primary fluid for certain conditions. The location of the slit with respect to the curved surface provides another variable which may be utilized to meet primary fluid velocity and entrainment characteristics required for a given application. One skilled in the art will know how to adjust the variables to their particular demands.

The primary fluid, which is usually gas, may be introduced into the chamber at various pressures which achieve primary fluid flow required for specific applications.

The temperature of the primary fluid may be adjusted as required in order to retard or accelerate the cooling effect upon the process. Likewise, temperature of the metal supply may be adjusted to prolong or shorten the time required for cooling of the particles or droplets.

As stated above, Coanda-type devices are not only capable of potentially high deposition rates, far in excess of conventional thermal-spray methods, but have the unique ability to add elements, chemical compounds of either a ceramic or metallic type; these additions are entirely independent of thermodynamic limitations.

These inert or chemically active particles can be added to the alloy at the moment of solidification. In some instances, for example, it may be desirable to inject small amounts of a chemically active gas to the solidifying droplets. This feature might be especially appealing for the generation of new creep-resistant aluminum alloys containing thermally stable oxide dispersoids. Further, large volume fractions of carbides, borides or silicides might be incorporated in high speed steels for additional wear resistance and improved cutting performance. It is possible to add these oxides, carbides, borides or silicides to both ferrous and nonferrous metals as, for instance, aluminum, titanium, zirconium, iron and nickel-based alloys.

The flexibility of the Coanda deposition process offers a wide variety of alloy design and consolidation opportunities. For example, as mentioned previously, inert or chemically active particles can be entrained or added to the gas stream emanating from the slit and subsequently be incorporated into the liquid droplets without excessive segregation or clustering. Large volume fractions of hard carbides, borides or silicides may be added to high alloy steels to enhance the wear and abrasion resistance of clad plates for mining or earth-moving equipment.

The inherent velocity of this system permits the required high droplet impact speed and disintegration into extremely fine droplets. Combination with other technologies, such as plasma arc, may be employed to enhance the process.

Figure 3A:
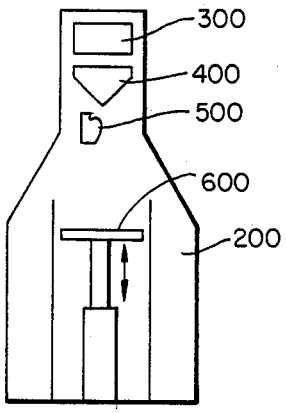
FIGS. 3A and 3B are schematic diagrams of the basic system of the present invention, for example, FIG. 3A showing a retraction-type holder/collector, and FIG. 3B showing a linear moving holder/collector.
Figure 3B:
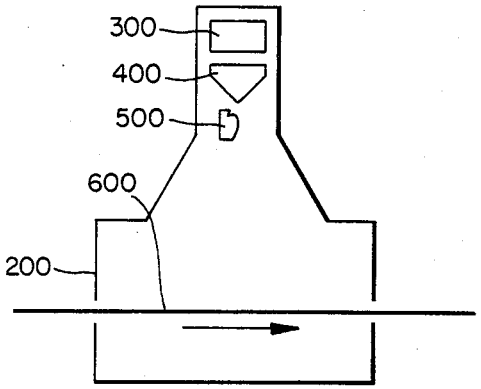

The apparatus and process for both casting and coating systems of the present invention includes five basic components: a chamber 200, a furnace 300, a tundish 400, a Coanda generating device 500, and a collector 600. Looking to FIGS. 3A and 3B, the basic arrangement of these components is shown. A chamber 200 is required for both embodiments. The actual physical arrangement of the respective chambers will differ because of the differences in movement of the collector 600. Of course, the preferred configuration of the chamber depends upon the specific application and use of the disclosed processes, and can vary from a single purpose chamber designed and built for a specific type of casting, or ingot buildup, to a general purpose chamber which is capable of handling a variety of different applications. However, certain basic requirements are necessary for any of the chambers. The chambers are required to contain and effect the overall process and should be capable of permitting accurate and precise atmosphere control, and must be sized and shaped to accommodate the various configurations to be cast and/or coated.

The furnace element 300 will depend upon the metal material involved, the types of gases used, the degree of temperatures required, what atmospheric control must be effected, and the like. A number of known metal melting techniques can be used and furnaces to effect same as already known in the metallurgical art can be satisfactorily adapted for the furnace structure of the present invention.

Figure 4:
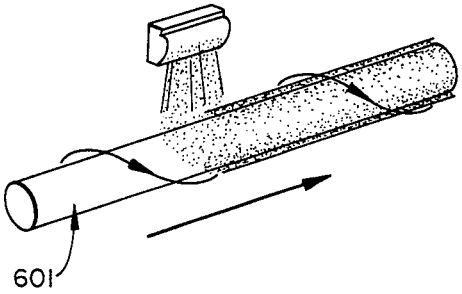
FIGS. 4, 5, and 6 show collector/holder configurations as usable with the system of the present invention.

FIG. 4 shows a collector/holder arrangement wherein an elongated pipe 601 is spray coated by a suitable Coanda generating device. The pipe can be rotated by means not shown and moved in a lateral direction as indicated by the arrows in the drawing.

Figure 5:
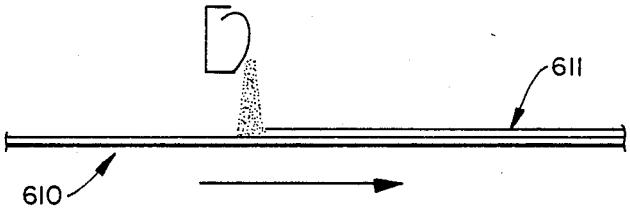

FIG. 5 shows another type of collector/holder comprising a flat, linearly moving surface or substrate 610 moving in the direction of the arrow by means not shown. A coating or casting 611 is deposited thereon by a suitable Coanda device.

Figure 6:
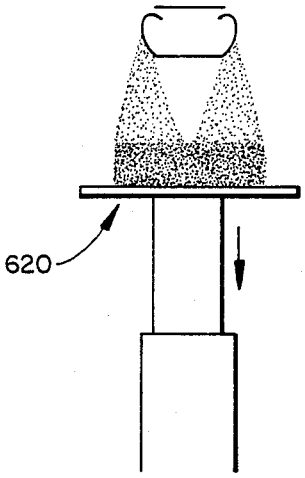

FIG. 6 shows, in schematic form, a retractingtype holder/collector 620 for depositing casting-type ingots or billets by means of a Coanda device. In this case, the Coanda device is of a circular nature. Objects may be cast to specific shapes by providing the appropriate mold form into which the spray particles may be deposited.

As can be seen by the above specific examples, the possible combinations and variations of collector/holders are quite large in number, and the above examples are not to be considered limiting, but merely as typical examples of ones that may be used with the present invention.

The majority of the primary and secondary fluids have been gases. As stated above, various mixes of gases can be used to achieve certain desired effects, and, of course, additional liquids, gases, or even solids, can be added to these gases for changing the composition thereof.

The above invention has been used to produce particles of various metals, such as lead, tin, cast iron and stainless steel (300 series). It has been used to coat cast iron upon a stainless steel substrate to achieve a fully integrated interface. Tin powders have been produced in the range as small as several microns and it has also been used to produce stainless steel powder and shot in the ranges requires for shot peening purposes.

Some typical examples showing the use of the above invention are set forth below. These examples are merely illustrative and are not to be interpreted as setting forth the metes and bounds of the present invention.

EXAMPLE I

| PRODUCTION OF TIN POWDER | |
|---|---|
| Foil: | 0° attitude |
| Slit: | Oriented 30° from 0 on curved foil surface |
| Slit Opening: | 0.012" |
| Material: | Sn |
| Temperature of Sn: | 650° F. |
| Primary Fluid: | $N_2$ (at room temperature) |
| Chamber Pressure: | 50 psi |
| Secondary Fluid: | $N_2$ (at room temperature) |
| Molten Stream Orifice: | $\frac{1}{8}$" internal diameter |
| Drop Distance From Orifice to Slit: | $\frac{3}{8}$" |

EXAMPLE II

| CAST IRON ON STAINLESS STEEL | |
|---|---|
| Foil: | 20° attitude |
| Slit: | 30° from 0 axis on foil |
| Slit Opening: | 0.008" |
| Material: | Cast Iron coating/stainless steel substrate |
| Temperature of Iron: | 2650° F. |
| Primary and Secondary Fluids: | $N_2$ (at room temperature) |
| Chamber Pressure: | 50 psi, 90° F. |
| Molten Stream Orifice: | $\frac{1}{8}$" internal diameter |
| Drop Distance From Orifice to Slit: | 2" |
| Drop Distance (Foil to Substrate): | about 12" |
| Cast Coating: | $\frac{1}{8}$"-$\frac{1}{4}$" |

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A device for producing a metallic particle comprising:

means defining a Coanda surface;

means for flowing a first fluid along said Coanda surface;

a second fluid located adjacent said Coanda surface to be influenced by the flow of said first fluid toward an intersection with said first fluid;

means for introducing a flow of molten metal between said first and second fluids to permit entrainment and associated breakup of said molten metal into metallic droplets; and means for receiving said metallic droplets on a substrate which forms the metallic droplets into a coated or molded article.

2. The device defined in claim 1 further including means for controlling the properties of said fluids.

3. The device defined in claim 1 further including a housing having one side thereof including said Coanda surface.

4. The device defined in claim 1 wherein the Coanda surface is separate from the housing.

5. The device defined in claim 3 wherein said housing has a chamber defined therein and means for introducing said first fluid into said chamber and a fluid exit means defined in said housing adjacent said Coanda surface.

6. The device defined in claim 1 wherein said molten metal flow introducing means is elongate to define a sheet of molten metal.

7. The device defined in claim 1 wherein the metal flow introducing means is a series of one or more orifices of various configurations.

8. The device of claim 1 wherein the Coanda surface is configured in a linear shape.

9. The device of claim 1 wherein the Coanda surface is configured other than linear.

10. The device defined in claim 1 wherein said means for collecting said metallic droplets includes a substrate or collector movable relative to the flow of metallic particles.

11. The device defined in claim 10 wherein said movement is traversely to the flow of metallic droplets.

12. The device defined in claim 10 wherein said means for collecting said metallic droplets includes a holder/collector which moves in the same direction but substantially away from the flow of the metallic droplets.

13. A device as set forth in claim 1 wherein the Coanda device is movable in relation to the substrate or collector.

14. Apparatus for producing metallic articles comprising:

means for producing a Coanda Effect;

means for providing a source of molten metal to be entrained in said Coanda Effect; and means for receiving metal droplets as produced by the aforesaid structure which forms the metallic droplets into a coated or molded article.

15. The apparatus described in claim 14 wherein there is provided a housing means to isolate and control the process.

16. The apparatus of claims 14 or 15 wherein the metal droplets are deposited on a substrate to produce a metal coated article.

17. The apparatus of claims 14 or 15 wherein the metal droplets are deposited on a collector to produce a cast shape.

18. The apparatus as set forth in claim 14 wherein said receiving means is a linear moving holder.

* * * * *